US007633028B2

(12) United States Patent
Böbel et al.

(10) Patent No.: US 7,633,028 B2
(45) Date of Patent: Dec. 15, 2009

(54) ELECTRIC SWITCH MODULE

(75) Inventors: Ralf Böbel, Holzwickede (DE); Berthold Esders, Schalksmuble (DE); Hugo De Winter, Wetteren (BE); Martin Sabelus, Rheinbreitbach (DE); Jan Willems, Wetteren (BE); Sven De Vis, Wetteren (BE); Bart Broeckaert, Wetteren (BE)

(73) Assignee: Recticel Automobilsysteme GmbH, Rheinbreitbach (DE)

( * ) Notice: Subject to any disclaimer, the term of this patent is extended or adjusted under 35 U.S.C. 154(b) by 0 days.

(21) Appl. No.: 10/570,587

(22) PCT Filed: Sep. 8, 2004

(86) PCT No.: PCT/IB2004/051715

§ 371 (c)(1),
(2), (4) Date: Mar. 5, 2007

(87) PCT Pub. No.: WO2005/024874

PCT Pub. Date: Mar. 17, 2005

(65) Prior Publication Data

US 2007/0131527 A1 Jun. 14, 2007

(30) Foreign Application Priority Data

Sep. 9, 2003 (DE) ..... 103 41 887

(51) Int. Cl.
*H01H 19/06* (2006.01)

(52) U.S. Cl. ..... 200/302.3; 200/339

(58) Field of Classification Search ..... 200/5 R, 200/6 A, 339, 31–317, 517, 302.3
See application file for complete search history.

(56) References Cited

U.S. PATENT DOCUMENTS

| | | | | |
|---|---|---|---|---|
| 4,958,148 | A * | 9/1990 | Olson | 345/174 |
| 5,448,028 | A | 9/1995 | Filion et al. | |
| 5,669,487 | A * | 9/1997 | Sakata | 200/339 |
| 5,876,243 | A * | 3/1999 | Sangawa | 439/519 |
| 5,900,431 | A * | 5/1999 | Molina et al. | 514/475 |
| 5,990,431 | A | 11/1999 | Wright | |
| 6,054,655 | A | 4/2000 | Rudolph et al. | |
| 6,093,900 | A | 7/2000 | Wisskirchen et al. | |

(Continued)

FOREIGN PATENT DOCUMENTS

DE 03533719 3/1987

(Continued)

OTHER PUBLICATIONS

The Search report for the International application.

*Primary Examiner*—Michael A Friedhofer
*Assistant Examiner*—Lisa N Klaus
(74) *Attorney, Agent, or Firm*—Margaret Polson; Oppedahl Patent Law Firm LLC

(57) ABSTRACT

An electric switch module has one or more electric switches arranged on a substrate (7) of which at least one is designed as a push-pull rocker switch (2, 3) having an actuator (4) formed by a projection (5) that is asymmetrical to its tilting axis (6). The module is characterized in that the top side of the substrate (7), together with the actuators (4) of its switches (2, 3), is covered by a flexible outer skin (10*a*) that also covers the projection (5) that forms the actuator (4) of the at least one rocker switch (2, 3).

15 Claims, 2 Drawing Sheets

U.S. PATENT DOCUMENTS

| | | | | |
|---|---|---|---|---|
| 6,737,592 | B1 * | 5/2004 | Hoang et al. | 200/1 B |
| 6,794,592 | B1 * | 9/2004 | Liu et al. | 200/302.3 |
| 6,894,234 | B1 * | 5/2005 | Sottong | 200/5 R |
| 7,145,090 | B2 * | 12/2006 | Shimizu | 200/302.1 |
| 7,145,091 | B1 * | 12/2006 | Wang | 200/302.3 |
| 7,285,739 | B1 * | 10/2007 | Chen | 200/302.1 |
| 7,294,800 | B2 * | 11/2007 | Koyama | 200/302.1 |

FOREIGN PATENT DOCUMENTS

| | | | |
|---|---|---|---|
| DE | 197 40 382 | A1 | 3/1999 |
| DE | 19740382 | | 3/1999 |
| DE | 19853818 | | 12/1999 |
| DE | 198 53 819 | A1 | 5/2000 |
| DE | 19853819 | | 5/2000 |
| DE | 10206777 | | 9/2003 |
| GB | 2367531 | | 4/2002 |
| JP | 08-273475 | | 10/1996 |
| JP | 10-021774 | | 1/1998 |
| JP | 2000-215760 | | 8/2000 |

* cited by examiner

ELECTRIC SWITCH MODULE

CROSS REFERENCE APPLICATIONS

This application is a national stage application of PCT application no. PCT/IB2004/051715 filed on Sep. 8, 2004 and claiming priority from German application 103 41 887.3 filed on Sep. 9, 2003.

BACKGROUND

The invention relates to an electric switch module with one or several electric switches disposed on a carrier. At least one switch is a push-pull rocker switch with an actuation member formed by an actuation projection asymmetrically with respect to its rocking axis.

Such electric switch modules are located, for example, in motor vehicles, generally in the proximity of the arm rest of the interior trim paneling of the door. Such a switch module, if it is located on the inside of the driver door, comprises several rocker switches. These switches are used for actuating the drive of the window lifting mechanism associated with the individual motor vehicle door. These rocker switches are formed as push-pull switches. Following a push actuation of the switch, the window pane of a motor vehicle door is lowered, and thus opened. A pull actuation leads to the raising of the previously opened pane and consequently to the closing of the window.

Such rocker switches include an actuation member with an actuation projection disposed asymmetrically with respect to the rocking axis of the actuation member. The actuation projection forms an undercut for reaching behind the actuation projection. This allows room for the pull actuation of the rocker switch. Safety requires that a pull function is only possible through a pull actuation of the actuation member and not through an unintentional push actuation of the actuation member in a region that is opposite to the actuation projection with respect to the rocking axis. For this purpose, the push-pull rocker switches which must fulfill these requirements are disposed so far under a lining that only the cam-like actuation projection extends from the lining. However, such measures restrict the freedom to create the design of such a switch module.

In addition to the above described rocker switches, additional parts of such an electric switch module integrated into the arm rest of a motor vehicle door can include spring-loaded and/or are four-way switches for adjusting the outside mirrors. In the conceptualization of these switch module it must be ensured that no splash water penetrates into the interior of the switch module through the gap between the actuation members of the switches and a lining enclosing the actuation members. Lastly, the functional capability of the switch module must be ensured even if a motor vehicle door is opened during rain. For this reason, the gap between the movable actuation members and the lining must be appropriately sealed.

Building on the discussed prior art, the invention's aim is to develop further an electric switch module according to the species and described above, in such manner allows greater freedom to design the control top side of such a switch module and that the impermeability to water can be realized to the highest desired degree feasible and with minimal additional expenditures.

The foregoing example of the related art and limitations related therewith are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tool and methods which are meant to be exemplary and illustrative, not limiting in scope. In various embodiments, one or more of the above described problems have been reduced or eliminated, while other embodiments are directed to other improvements.

According to the invention this aim is attained through an electric switch module in which the top side of the carrier with the actuation members of the switches is covered with a flexible outer skin enclosing the actuation elements of the at least one electric switch disposed on the carrier.

In this switch module the control top side of the carrier is covered completely with a flexible outer skin laid over the actuation elements of the electric switches. This outer skin encloses the actuation projection of the actuator of the at least one rocker switch. Due to the outer skin covering the carrier, the electric components of the switch module are effectively protected against splash water. Due to the flexible properties of the outer skin the actuation members of the utilized switches, located under the outer skin, can readily be actuated. For this purpose the outer skin also encloses the actuation projection of the at least one push-pull rocker switch. Especially practical is an implementation in which the outer skin has expansible properties and is thus elastic. With such an outer skin, actuation members of rocker switches which have a high structure and/or have a relatively long actuation path can also be enclosed.

Through the outer skin covering the carrier, an integrative gapless surface is provided which allows the responsible designer markedly greater freedom as be does not need to take into account safety-related requirements. Should an actuation protection relevant to safety be necessary, it is located beneath the outer skin and is consequently not visible to the user. With such an outer skin, the actuation members of the employed rocker switches, which are sensed by touch through the outer skin, can be designed without consideration of a possibly necessary actuation prevention device. When designing the electric switch module, the visible side of the outer skin can be entirely or partially provided with an embossed pattern if desired. Such an outer skin can be comprised of polyurethane or silicone, for example.

The margin of such an outer skin can possibly be connected through an adhesive foam with the encircling margin of the carrier. Due to its flexible properties, the outer skin does not have to be connected with the carrier over the entire area, respectively the actuation members of the rocker switches supported on the carrier. Rather, it is in principle sufficient to connect by adhesion the outer skin in specific locations of the carrier and the actuation member of a rocker switch. In order to make possible the operability of the rocker switch over its entire range of motion, the adhesion sites for connecting the outer skin with the carrier and/or the actuation member of a rocker switch supported by it can take into consideration the possible movement of the outer skin during the actuation of the actuation member. Accordingly, one section of the outer skin, for example located in a recessed grip or actuation of the rocker switch, can be resting loosely so that during a pull actuation of the actuation member of the rocker switch this region of the outer skin is raised from the underlying support, while in other regions the outer skin is fixed relative to the underlying support. To position the flexible outer skin on the top side of the carrier, positioning knobs or beads projecting downward from the outer skin can be provided, which engage corresponding recesses or grooves of the carrier. For example, the groove can be the gap present in any case between the actuation members of the switches and the carrier.

Covering the carrier with its electric switches with the above described outer skin, further, has the advantage that the mechanical structural parts—carrier, actuation members, optionally actuation protection devices—can be conceptualized with less concern for their functional scaling-down regarding their implementation.

In addition to the exemplary aspects and embodiments described above, further aspects and embodiments will become apparent by reference to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Exemplary embodiments are illustrated in referenced figures of the drawings. It is intended that the embodiments and figures disclosed herein are to be considered illustrative rather than limiting. Also, the terminology used herein is for the purpose of description and not of limitation.

DETAILED DESCRIPTION OF THE DRAWINGS

Figure 1:
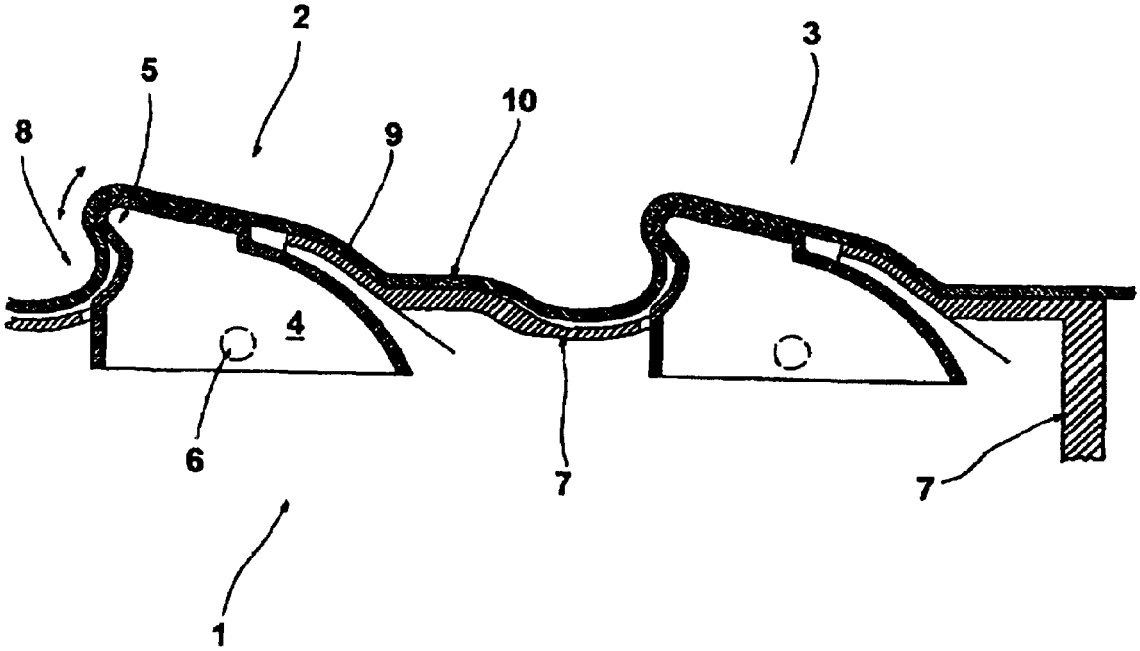
FIG. 1 is a schematic longitudinal section through an electric switch module.

In the following, the invention will be explained in conjunction with an embodiment example with reference to FIG. 1, which depicts a schematic longitudinal section through an electric switch module 1. The switch module 1 is integrated into the arm rest of a motor vehicle door, not further described. The switch module 1 comprises two push-pull rocker switches 2, 3 disposed one behind the other. The push-pull rocker switches 2, 3 serve to actuate window pane lifting motors. Each of the push-pull rocker switches 2, 3 has an actuation member 4 with an asymmetric actuation projection 5 implemented as a cam. This and the following description of the subject matter of the invention refer to the push-pull rocker switch 2. The further push-pull rocker switch 3 of the depicted switch module 1 is structured correspondingly. For the sake of clarity, the further components, in particular the electric components, of the two push-pull rocker switches 2, 3 are not shown.

The actuation member 4 of the push-pull rocker switch 2 is supported rotatably about a rocking axis 6 on a carrier denoted overall by the reference symbol 7. Starting from the zero position of the actuation member 4, depicted in the figure, this member can be moved corresponding to the double-arrow label. To move the actuation member 4 the cam-like actuation projection 5 is used. The actuation projection 5 is formed such that it forms a lower recessed grip 8. When the actuation projection 5 is moved upward, the pane lifting motor is activated through push-pull rocker switch 2 to raise the pane and, with a reverse movement of the actuation member 4, is activated to lower the pane.

The carrier 7 has an actuation protection lining 9 extending above the region of the actuation member 4 opposite the actuation projection 5 with respect to the rocking axis 6. The actuation protection lining 9 is rigid, such that the unintended actuation of the actuation member 4 is prevented in the section opposite the actuation projection 5 with respect to rocking axis 6. Through this measure, the raising of the pane activated by the push-pull rocker switch 2 cannot take place unintentionally through a push actuation in the section opposite the actuation projection 5 relative to the rocking axis 6.

The carrier 7 with all of its switches 2, 3 is covered by an integrative flexible outer skin 10 with a certain material elasticity, for example silicone. The outer skin 10 encloses the actuation projection 5 of the actuation member 4 and can, for example, be adhered with the actuation member 4 in this section. As shown in the figure, in the region of the recessed grip 8 the outer skin 10 is not connected with the actuation member 4 or with the carrier 7, as it is the region of the actuation projection 5 and in the remaining regions in which the outer skin 10 adjoins the carrier 7. Due to the material properties of the outer skin 10 and the described selective connection of the outer skin 10 with the carrier 7 and with the actuation projection 5, the actuation projection 5 of the actuation member 4 can travel a reasonable distance without being compromised through the enclosing outer skin 10. This is enhanced through the elastic properties of the material of the outer skin 10.

Figure 2:
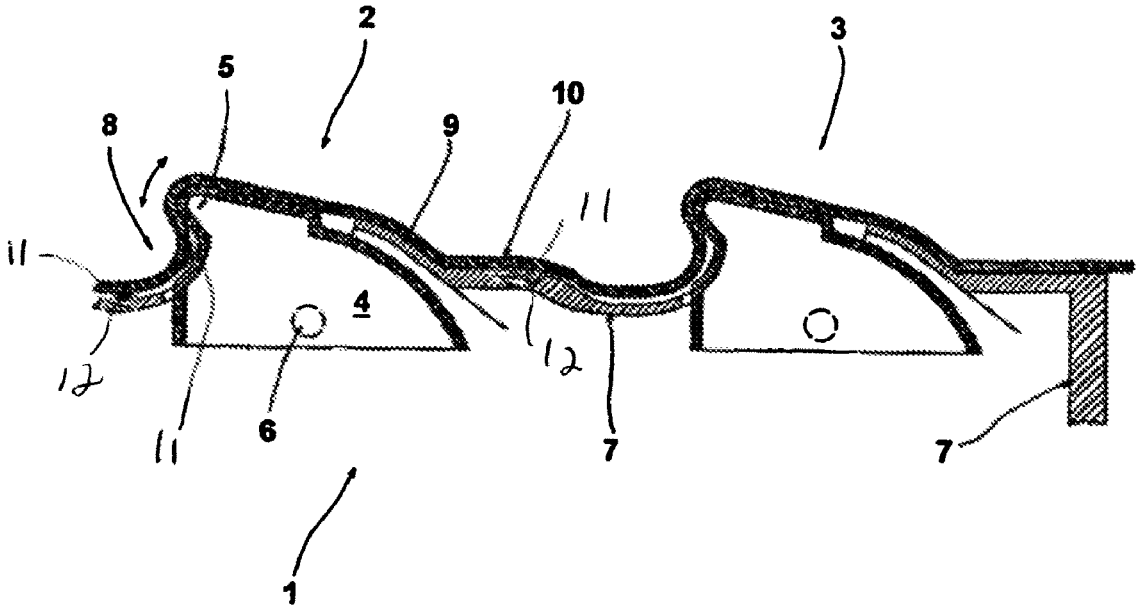
FIG. 2 is a schematic longitudinal section of a second embodiment.

As shown in FIG. 2, the outer skin 10 can have positioning knobs 11, which can be formed as downwardly projecting beads, that engage with grooves 12 in the carrier 7. Alternative, the positioning knobs 11 can engage with the recessed grip 8.

All gaps between the actuation members 4 of the individual switches 2, 3 and the carrier 7 are closed at the top side by the outer skin 10, such that the switch module 1 is overall protected against splash water without additional measures being required for this purpose. The figure also shows that the impression of the two push-pull rocker switches 2, 3 is overall more readily apparent and is not only limited to the actuation projection 5. The outer skin 10 is connected with or is also a portion of an outer skin of the interior trim paneling of a door. Through the outer skin 10, consequently, an integrative outward appearance is provided. Superficial embossing of the outer skin 10, for example grained in the form of leather, could additionally lend this skin an attractive appearance and enhance an overall integrative impression of the surface.

While a number of exemplary aspects and embodiments have been discussed above, those of skill in the art will recognize certain modifications, permutations, additions and sub-combinations therefore. It is therefore intended that the following appended claims hereinafter introduced are interpreted to include all such modifications, permutations, additions and sub-combinations are within their true sprit and scope. Each apparatus embodiment described herein has numerous equivalents.

LIST OF REFERENCE SYMBOLS

1 switch module
2 push-pull rocker switch
3 push-pull rocker switch
4 actuation member
5 actuation projection
6 rocking axis
7 carrier
8 recessed grip
9 actuation protection lining
10 outer skin

The invention claimed is:

1. An electric switch module comprising:

at least one electric switch disposed on a carrier, said carrier having a top side;

of which at least one electric switch is a push-pull rocker switch with an actuation member formed by an actuation projection asymmetrical with respect to an axis of said actuation member;

a recessed grip under the actuation projection functioning to allow the user to perform the pull motion with a finger tip; and wherein the top side of the carrier with the at least one actuation member of the at least one switch is covered by a flexible outer skin which conformingly encloses a top and at least a portion of an underside of the actuation projection of the actuation member and conforms to the recessed grip of the at least one rocker switch.

2. The electric switch module as claimed in claim 1, wherein an underside of the outer skin rests intimately on the top side of the carrier.

3. The electric switch module as claimed in claim 1 or 2, wherein a margin of the outer skin is connected with the carrier through an adhesion foam.

4. The electric switch module as claimed claim 3, wherein the outer skin further comprises downwardly projecting positioning knobs which engage grooves of the carrier.

5. The electric switch module as claimed claim 3, wherein associated with the at least one rocker switch is an actuation protection located beneath the outer skin which functions to prevent an unintentional push actuation on the actuation member to move it into a pull position.

6. The electric switch module as claimed claim 3, wherein the outer skin further comprises downwardly projecting positioning knobs which engage gaps between the carrier and the switches disposed therein.

7. The electric switch module as claimed in one of claim 1 or 2, wherein the outer skin further comprises downwardly projecting positioning knobs which engage grooves of the carrier.

8. The electric switch module as claimed claim 7, wherein associated with the at least one rocker switch is an actuation protection located beneath the outer skin which functions to prevent an unintentional push actuation on the actuation member to move it into a pull position.

9. The electric switch module as claimed in one of claim 1 or 2, wherein associated with the at least one rocker switch is an actuation protection located beneath the outer skin which functions to prevent an unintentional push actuation on the actuation member to move it into a pull position.

10. The electric switch module as claimed in one of claim 1 or 2, wherein the outer skin is comprised of a material selected from a group consisting of polyurethane and silicone.

11. Switch module as claimed in claim 10, characterized in that the outside surface of the outer skin is embossed to create a surface pattern.

12. The electric switch module as claimed in one of claim 1 or 2, wherein the outer skin further comprises downwardly projecting positioning knobs which engage gaps between the carrier and the switches disposed therein.

13. An electric switch module comprising:

at least one electric switch disposed on a carrier, said carrier having a top side;

wherein at least one electric switch is a push-pull rocker switch with an actuation member formed by an actuation projection asymmetrical with respect to an axis of said actuation member;

a recessed grip formed by the underside of the actuation member; and wherein the top side of the carrier with the at least one actuation member of the at least one switch is covered by a flexible outer skin which conformingly encloses a to and at least a portion of an underside of the actuation projection of the actuation member and conforms to the recessed grip of the at least one rocker switch such that the recessed grip is accessible to a user.

14. An electric switch module comprising:

at least one push pull switch means disposed on a carrier, said carrier having a top side;

said push pull switch means functioning to allow a user to depress a projection of the push pull switch means to activate one function and to pull on the projection of the push pull switch means to activate another function;

said push pull switch means having a recessed grip means under the projection functioning to allow the user to perform the pull motion with a finger tip; and a flexible cover means conformingly covering the top side of the carrier, top and at least a portion of an underside of the push pull switch means and the projection and conforming to the recessed grip such that the recessed grip means is accessible and enclosed by the flexible cover means.

15. The electric switch module as claimed in one of claim 13 or 14, wherein associated with the at least one rocker switch is an actuation protection located beneath the outer skin which functions to prevent an unintentional push actuation on the actuation member to move it into a pull position.

* * * * *